US006669585B2

(12) United States Patent
Sutherland et al.

(10) Patent No.: US 6,669,585 B2
(45) Date of Patent: Dec. 30, 2003

(54) HUNTING ARROW

(75) Inventors: Warren E. Sutherland, Louisa, KY (US); Kim R. Bradford, Swanton, OH (US); Harold R. Stine, Delta, OH (US)

(73) Assignee: Inspired & Created Concepts, LLC, Swanton, OH (US)

( * ) Notice: Subject to any disclaimer, the term of this patent is extended or adjusted under 35 U.S.C. 154(b) by 0 days.

(21) Appl. No.: 10/348,208

(22) Filed: Jan. 21, 2003

(65) Prior Publication Data

US 2003/0166425 A1 Sep. 4, 2003

Related U.S. Application Data

(60) Provisional application No. 60/351,387, filed on Jan. 24, 2002.

(51) Int. Cl.[7] ..... F42B 6/02
(52) U.S. Cl. ..... 473/581
(58) Field of Search ..... 473/578, 581, 473/582, 585; 124/57

(56) References Cited

U.S. PATENT DOCUMENTS

| | | | | |
|---|---|---|---|---|
| 3,893,866 A | | 7/1975 | Hollingsworth | |
| 4,212,463 A | | 7/1980 | Repinski et al. | |
| 4,277,069 A | | 7/1981 | Rouse | |
| 4,380,340 A | | 4/1983 | Simo | |
| 4,533,146 A | | 8/1985 | Schaar | |
| 4,735,612 A | | 4/1988 | Chevalier | |
| 4,944,520 A | | 7/1990 | Fingerson et al. | |
| 5,183,259 A | | 2/1993 | Lyon | |
| 5,762,574 A | * | 6/1998 | Mashburn | 473/581 |
| 6,059,677 A | | 5/2000 | Breshears | |
| 6,238,310 B1 | * | 5/2001 | Morrison | 473/581 |
| 6,241,634 B1 | * | 6/2001 | Armer, Jr. | 473/581 |

* cited by examiner

*Primary Examiner*—Jacob K. Ackun
(74) *Attorney, Agent, or Firm*—Emch, Schaffer, Schaub & Pocello Co., L.P.A.

(57) ABSTRACT

The present invention is directed to an arrow having a hollow cylindrical shaft having a first end and a second end. An insert is positioned in the first end of the hollow shaft. The insert has an increased diameter section that defines a shoulder. A threaded connection extends from one side of the increased diameter section. An engagement section extends from the increased diameter section in a direction opposite to the threaded connection. The engagement section is configured to engage the interior surface of the hollow shaft to removably secure the insert to the hollow shaft. A hunting type of arrow head is secured to the threaded connection and arrowhead extends from the hollow shaft. At least one opening extends through the insert to place the interior of the hollow shaft in communication with the atmosphere. The at least one opening provides a means whereby bodily fluids from an animal shot with the arrow can escape from the wound created by the arrow so that the animal is killed in a quicker and more humane manner.

15 Claims, 3 Drawing Sheets

HUNTING ARROW

BACKGROUND OF THE INVENTION

The present invention is generally directed to a hunting arrow concept. More particularly the arrow is designed to enhance the wound created in an animal that is hit with the arrow result in a quicker and more humane death for the animal. When hunting an animal with a bow and arrow, it is important to create a wound with the arrow that quickly and humanely kills the animal. If the animal is not killed quickly, it can suffer more than is necessary. In addition, the animal may move from the area where it was initially shot with the arrow and make it more difficult for the hunter to complete the kill. If the animal is able to move a significant distance, the hunter may lose track of the animal and not be able to use the animal as a source of food. The arrow of the present invention is designed to enhance the bleeding at the wound created by the arrow to assist in accomplishing a quick and human death for the animal.

SUMMARY OF THE INVENTION

The present invention is directed to an arrow having a hollow cylindrical shaft having a first end and a second end. An insert is positioned in the first end of the hollow shaft. The insert has an increased diameter section that defines a shoulder. A threaded connection extends from one side of the increased diameter section. An engagement section extends from the increased diameter section in a direction opposite to the threaded connection. The engagement section is configured to engage the interior surface of the hollow shaft to removably secure the insert to the hollow shaft. A hunting type of arrowhead is secured to the threaded connection and arrowhead extends from the hollow shaft. At least one opening extends through the insert to place the interior of the hollow shaft in communication with the atmosphere. The at least one opening provides a means whereby bodily fluids from an animal shot with the arrow can escape from the wound created by the arrow so that the animal is killed in a quicker and more humane manner.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT(S)

Figure 1:
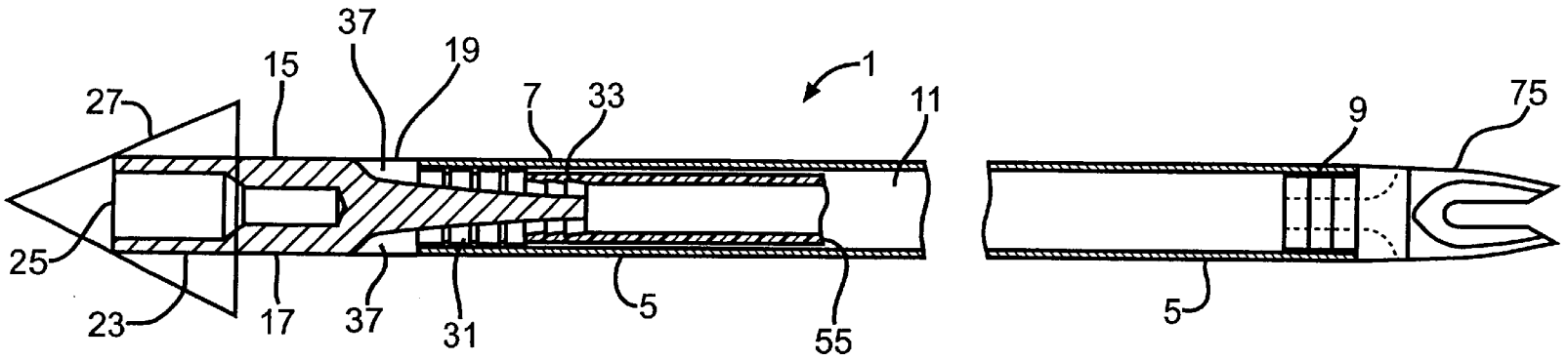
FIG. 1 is a side elevation view of the arrow of the present invention.

The present invention is generally directed to a hunting arrow concept. More particularly the arrow is designed to enhance the wound created in an animal that is hit with the arrow resulting in a quicker and more humane death for the animal. The features of the arrow of the present invention will be more fully understood by referring to the attached drawings in connection with the following description.

The arrow 1 of the present invention as shown in FIGS. 1–9 has a hollow shaft 5 having a first end 7, and a second end 9 and an interior chamber 11. An insert 15 is positioned on the first end 7 of the hollow shaft 5. The insert 15 has an increased diameter section 17 that defines a shoulder 19. The end 23 of the increased diameter section 17 has a threaded aperture 25 that is disposed to threadingly receive an arrowhead 27. The arrowhead 27 is usually a hunting type of arrowhead that is effective in hunting game.

Figure 3:
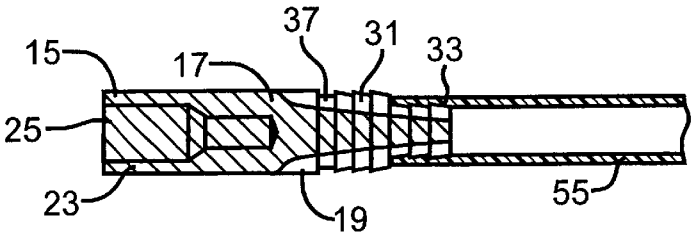
FIG. 3 is a partial side elevation view of a feature of the arrow of FIG. 1.
Figure 4:
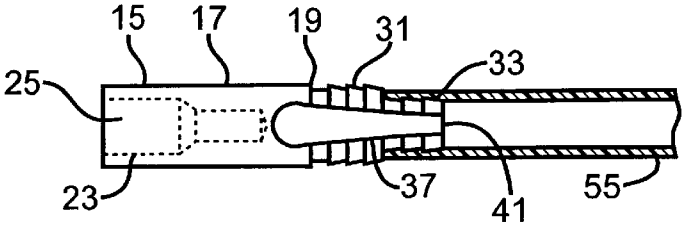
FIG. 4 is a top view of the feature of FIG. 3.
Figure 5:
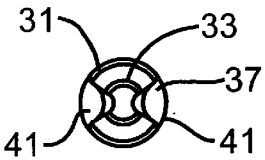
FIG. 5 is an end view of the feature of FIG. 3.

As shown in FIGS. 3–5, an engagement section 31 extends from the increased diameter section 17 in a direction opposite to the threaded aperture 25. The engagement section 31 has a diameter that is smaller than the diameter of the increased diameter section 17. The engagement section 31 is configured to be insertable into the interior chamber 11 of the hollow shaft 5. The engagement section 31 engages the interior of the hollow shaft to secure the insert 15 to the first end 7 of the shaft 5. Usually an interference type of fit is provided between the engagement section 31 and the interior chamber of the hollow shaft. However, adhesives can also be used to secure the engagement section 31 to the hollow shaft. A reduced diameter section 33 extends from the engagement section 31 in a direction away from the increased diameter section 17 and into the interior chamber 11 of the hollow shaft 5. When the insert 15 is positioned on the hollow shaft 5, the shoulder 19 created by the increased diameter section 17 acts as a stop that engages the end of the hollow shaft and indicates that the insert 15 is properly positioned with respect to the hollow shaft.

Figure 13:
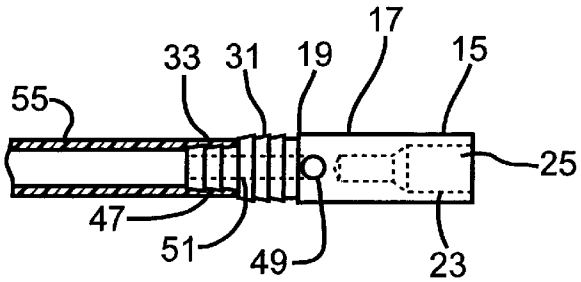
FIG. 13 is a partial side elevation view of a feature of the arrow of FIG. 2.
Figure 14:
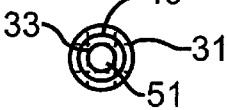
FIG. 14 is an end view of the feature of FIG. 13.

An opening 37 is provided in the insert 15 to place the interior chamber of the shaft 5 in communication with the atmosphere. The opening 37 can be at least on groove 41 that extends along increased diameter section 17, the engagement section 31 and the reduced diameter section 33. The groove 41 extends past the shoulder 19 formed by the increased diameter section 17 and provides a passageway that places the interior chamber 11 of the shaft 5 in fluid communication with the atmosphere. It is usually preferable to have at least two grooves 41 positioned in the inert 15 and grooves are usually spaced equidistant apart on the insert. The opening 37 as shown in FIGS. 13 and 14 can also be at least one passageway 47 that extends through the insert 15. The passageway can be an aperture 49 that is positioned in the increased diameter section 31 and connects with a bore 51 that extends substantially through the engagement section 31 and the reduced diameter section 33. The aperture 49 and bore 51 form the passageway 47 that places the interior chamber 11 of the shaft 5 in fluid communication with the atmosphere. It is usually preferable to have more than one aperture 49 positioned in the increased diameter section and in communication with the bore 51. Usually the apertures 49 are spaced equidistant apart on the increased diameter section.

Figure 2:
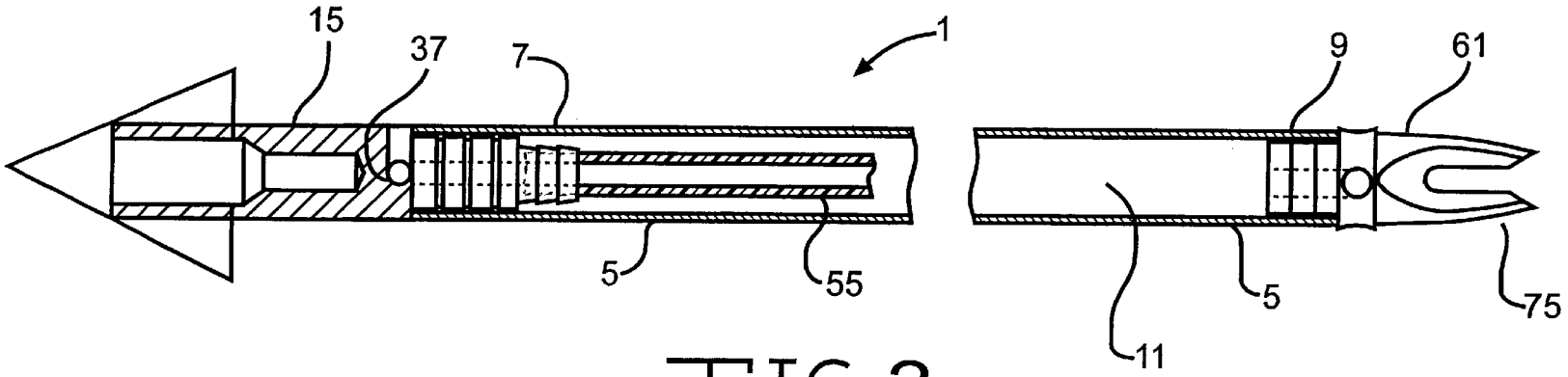
FIG. 2 is a side elevation view of another configuration for the arrow of the present invention.
Figure 6:
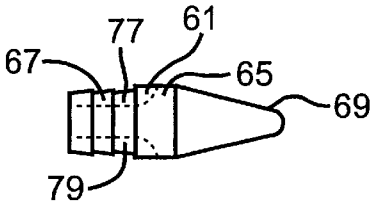
FIG. 6 is a partial side elevation view of a feature of the arrow of FIG. 1.
Figure 7:
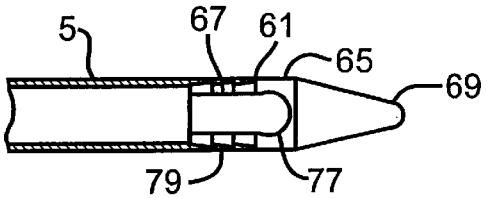
FIG. 7 is a partial top view of the feature of FIG. 7.
Figure 8:
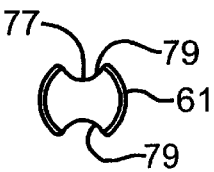
FIG. 8 is an end view of the feature of FIG. 6.

A tube 55 can be positioned in communication with the reduced diameter section 33 of the insert 15. As shown in FIG. 1, the tube 55 is positioned over the outer diameter of the reduced diameter section 33. As shown in FIG. 2, the tube 55 is positioned in the bore 51 that extends through the reduced diameter section 33. The tube 55 extends from the reduced diameter section 33 into the interior chamber 11 of the hollow shaft 5. The tube 55 has a length that is from about % to about % of the length of the shaft 5. The tube 55 has a diameter that is just slightly smaller than the inside diameter of the hollow shaft 5. The tube 55 is in fluid communication with the atmosphere through the opening 37 provided in insert 15. The tube 55 is normally made of plastic or other flexible material.

Figure 9:
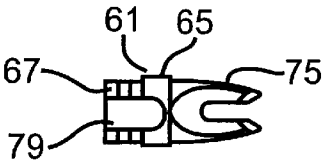
FIG. 9 is a side elevation view of a nock used in the arrow of FIG. 1.

As shown in FIGS. 6–9, a nock insert 61 is positioned in the second end 9 hollow shaft 5. The nock insert has a shoulder section 65 that has a diameter larger than the outer diameter of the shaft 5. A first section 67 extends from one end of the shoulder section 65 and is designed to extend into the interior chamber 11 of the shaft 5. The first section 67 acts to secure the nock insert 61 to the shaft 5. Usually an interference fit is provided between the first section 67 and the interior chamber 11 of the shaft 5. However, adhesives can also be utilized to secure the nock insert 61 to the shaft 5. The shoulder section 65 acts as a stop that engages the second end 9 of the shaft 5 and indicates that nock insert 61 is properly positioned with respect to the hollow shaft. A second section 69 extends from the other end of the shoulder section 65 in a direction opposite from the first section 67. The second section 69 is disposed so that a nock 75 as shown in FIG. 9 can be secured to the second section.

Figure 10:
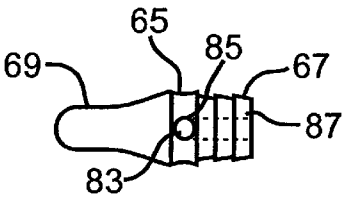
FIG. 10 is a partial side elevation view of a feature of the arrow of FIG. 2.
Figure 11:
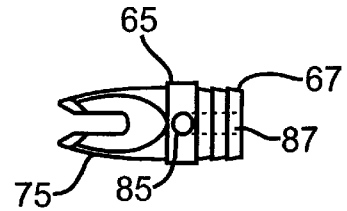
FIG. 11 is a top view of the feature of FIG. 10.
Figure 12:
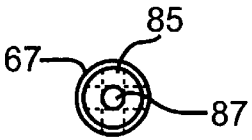
FIG. 12 is an end view of the feature of FIG. 10.

An opening 77 is provided in the nock insert 61 to place the interior chamber 11 of the shaft 5 in communication with the atmosphere. The opening 77 can be at least one groove 79 that extends along the shoulder section 65 and the first section 67 and provides a passageway that places the interior chamber 11 of the shaft 5 in fluid communication with the atmosphere. The groove 79 is substantially similar in shape and function as the previously described groove 41 in the insert 15 and more than one groove 79 can be positioned in the nock insert 61. The opening 77 as shown in FIGS. 10–12 can also be at least one passageway 83 that extends through the nock insert 61. The passageway can be an aperture 85 that is positioned in the shoulder section 65 and connects with a bore 87 that extends substantially through the first section 67. The aperture 85 and bore 87 form the passageway 83 that places the interior chamber 11 of the shaft 5 in fluid communication with the atmosphere. More than one aperture 85 can be positioned in the shoulder section and in communication wit the bore 87. The aperture 85 and bore 87 are substantially similar in shape and function with the previously described aperture 49 and bore 51 in the insert 15.

In hunting use, the arrow 1 of the present invention is shot at an animal by a bow or crossbow. The strings of the bow or crossbow engage the nock 75 so that the arrow can be propelled by the bow or crossbow. The arrowhead 27 is designed to penetrate the animal and cause sufficient damage to kill the animal. However, the arrow 1 does not always strike the animal in a location that results in damage significant enough for the animal to die quickly and humanely. Frequently, the animal will be capable of significant movement after being struck by the arrow 1 and this makes it more difficult for the hunter to quickly complete the kill of the animal. In some instances the wound created by the arrowhead 27 seals up around the shaft 5 of the arrow 1 and prolongs the time before the animal dies. Hunters want to complete the killing of the animal as quickly as possible to reduce suffering for the animal.

The arrow 1 of the present invention provides an opening 37 adjacent the arrowhead 27 and an opening 77 adjacent the nock 75 that allows bodily fluids such as blood to flow into and through the shaft 5 to increase the odds that the animal will be killed as quickly as possible by the arrow. Since one end of the arrow 1 usually extends from the animal, the bodily fluids can pass through shaft 5 of the arrow and assist in quickly and more humanely killing the animal. If the shaft 5 of the arrow 1 is broken off after entering the animal, the tube 55 that is connected to the reduced diameter section 33 of the insert provides a passageway for the bodily fluid of the animal to flow from the wound to accelerate the death of the animal. The tube 55 is formed of a flexible material so that the tube does not break if the shaft 5 of the arrow is broken. The tube 55 is designed to have a length so that the tube will extend from the animal if the arrow 1 is broken. Accordingly, the arrow of the present invention provides a means to enhance the effectiveness of a hunting arrow to quickly and humanely kill an animal.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. An arrow comprising:

a hollow cylindrical shaft having a first end and a second end;

an insert for positioning in the first end of the hollow shaft, the insert having an increased diameter section defining a shoulder, a threaded aperture positioned on one side of said increased diameter section and an engagement section that extends from the increased diameter section in a direction opposite to the threaded aperture, the engagement section being configured to engage the interior surface of the hollow shaft to removably secure the insert to the hollow shaft; and at least one opening extending through the insert to place the interior of the hollow shaft in communication with the atmosphere.

2. The arrow of claim 1 wherein the opening is at least one groove that is positioned in the increased diameter section and the engagement section.

3. The arrow of claim 1 wherein the engagement section has a reduced diameter section that extends into the hollow shaft, the opening extending into the reduced diameter section.

4. The arrow of claim 3 wherein a tube is connected to said reduced diameter section and said tube extends into the hollow shaft, the tube being in fluid communication with the opening.

5. The arrow of claim 2 wherein at least two grooves are positioned in said insert.

6. The arrow of claim 4 wherein the threaded aperture section is disposed for threadingly receiving an arrowhead.

7. The arrow of claim 4 wherein a nock insert is positioned in the second end of said hollow arrow, the nock insert including a first section for insertion into the hollow arrow, a shoulder section adjacent the first section, the shoulder section engaging the second end of the hollow arrow and a second section extending from the shoulder section in a direction opposite to the first section, the second section being disposed to secure a nock to the nock insert and the arrow.

8. The arrow of claim 7 wherein at least one groove is positioned in the first section and shoulder section of the nock insert to place the interior of the hollow arrow in communication with the atmosphere.

9. The arrow of claim 8 wherein at least two groves are positioned in the nock insert.

10. The arrow of claim 3 wherein the opening is at least one passageway that extends through the increased diameter section, the engagement section and the reduced diameter section to place the interior of the hollow shaft in communication with the atmosphere.

11. The arrow of claim 7 wherein at least one passageway extends through the first section and shoulder section of the nock insert to place the interior of the hollow arrow in communication with the atmosphere.

12. The arrow of claim 10 wherein the passageway is defined by at least one aperture in the increased diameter that connects to a bore that is positioned in the insert, the bore extending from the at least one aperture to the interior of the hollow shaft.

13. The arrow of claim 11 wherein the passageway is defined by at least one aperture in the nock insert that connects to a bore that is positioned in the nock insert, the bore extending from the at least one aperture to the interior of the hollow shaft.

14. The arrow of claim 4 wherein the tube is made of a flexible material.

15. The arrow of claim 4 wherein the tube extends from about % to about ⅞ of the length of the hollow shaft.

* * * * *

UNITED STATES PATENT AND TRADEMARK OFFICE

CERTIFICATE OF CORRECTION

PATENT NO. : 6,669,585, B2 
DATED : December 23, 2003
INVENTOR(S) : Warren E. Sutherland, Kim R. Bradford and Harold R. Stine It is certified that error appears in the above-identified patent and that said Letters Patent is hereby corrected as shown below:

Column 6,
Line 16, delete the symbol "%" and insert -- 1/4 -- which correction would have Claim 15 read as follows:

15. The arrow of claim 4 wherein the tube extends from about 1/4 to about 7/8 of the length of the hollow shaft.

Signed and Sealed this

Twenty-third Day of March, 2004

JON W. DUDAS
*Acting Director of the United States Patent and Trademark Office*